US005453960A

United States Patent [19]

Terés et al.

[11] Patent Number: 5,453,960

[45] Date of Patent: Sep. 26, 1995

[54] WATCH INCLUDING A MANUAL CONTROL DEVICE

[75] Inventors: Yvan Terés, La Chaux-de-Fonds; Joachim Grupp, Neuchâtel, both of Switzerland

[73] Assignee: Asulab S.A., Bienne, Switzerland

[21] Appl. No.: 408,310

[22] Filed: Mar. 22, 1995

[30] Foreign Application Priority Data

Mar. 24, 1994 [FR] France ..... 94 03480

[51] Int. Cl.[6] ..... G04C 17/00; G04B 19/00

[52] U.S. Cl. ..... 368/69; 368/224

[58] Field of Search ..... 368/10, 69, 70, 368/223, 224; 307/116, 125, 129; 340/657, 663

[56] References Cited

U.S. PATENT DOCUMENTS

| | | | |
|---|---|---|---|
| 3,871,170 | 3/1975 | Bergey | 368/65 |
| 3,983,690 | 10/1976 | McClintock | 368/69 |
| 4,047,010 | 9/1977 | Pecotto et al. | 368/223 |
| 4,055,755 | 10/1977 | Nakamura | 368/223 |
| 4,228,534 | 10/1980 | Fellrath et al. . | |
| 4,237,548 | 12/1980 | Fellrath | 368/69 |
| 4,247,929 | 9/1981 | Sasaki | 368/69 |
| 5,287,086 | 2/1994 | Gibb . | |

FOREIGN PATENT DOCUMENTS

| | | |
|---|---|---|
| 2749512 | 5/1978 | Germany . |
| 607872 | 6/1979 | Switzerland . |
| 631582 | 8/1982 | Switzerland . |
| 9014604 | 11/1990 | WIPO . |
| 9306572 | 4/1993 | WIPO . |

OTHER PUBLICATIONS

Mesures Regulation Automatisme, vol. 42, No. 9, Sep. 1977, Paris FR, pp. 69–73, C. Piguet et al.

Patent Abstracts of Japan, vol. 9, No. 214 (P–384) 31 Aug. 1985, JP 60 074 014 dated 26 Apr. 1985.

Patent Abstracts of Japan, vol. 5, No. 9 (P–45) (681) 21 Jan. 1981, JP 55 138 683 dated 29 Oct. 1980.

*Primary Examiner*—Vit W. Miska

*Attorney, Agent, or Firm*—Pollock, Vande Sande & Priddy

[57] ABSTRACT

This watch (1) includes a case (2), a glass (3) and at least one manual control device (22), which comprises a capacitive sensor (20) with a first electrode (5) arranged on the internal face (6) of the glass (3). The selective positioning of a finger (10) of a wearer of the watch (1) on the external face of the glass (3) enables a first capacity ($C_d$) to be formed between the first electrode (5) and earth (11) constituted by the case (2). A parasitic capacity ($C_p$) is present between the first electrode and the case.

The manual control device (22) also includes a voltage-frequency converter (22) whose oscillation frequency is determined by the first capacity ($C_d$), when the latter is formed by the presence of the finger, in combination with the parasitic capacity ($C_p$),

9 Claims, 1 Drawing Sheet

WATCH INCLUDING A MANUAL CONTROL DEVICE

FIELD OF THE INVENTION

The present invention relates to watches including a manual control device and, more particularly, to watches including a capacitive sensor, a first armature of which is arranged on the internal face of the watch-glass, a first capacity being formed between the first electrode and earth which is constituted by the case when a wearer of the watch places a finger on the external face of the watch.

BACKGROUND OF THE INVENTION

Watches including manual control devices intended to replace the usual external control means, such as push-buttons, are already known and are used to control the various functions of a watch like time-setting or starting and stopping a chronograph. Certain of these devices are composed of at least one transparent electrode arranged on the internal face of the watch-glass, the watch comprising a circuit arranged so as to process the signals which are generated when the wearer of the watch places his finger on the glass opposite this electrode.

A device of this type is disclosed in patent CH 607 872. In the arrangement disclosed in this patent, a conducting layer is arranged on the internal face of the watch-glass so as to form a capacitive sensor. This sensor forms, with an independent capacitor, a capacitive divider. An high frequency alternative voltage is applied to this divider by a generator. A detection device detects the voltage between the independent capacitor and the capacitive sensor. This detected voltage varies between two values, according to whether or not a finger is placed on the watch-glass. A comparator compares this detected voltage with a reference voltage and consequently provides a control signal having either a high logical state or a low logical state according to whether the finger is present or not.

A parasitic capacity is always present between the conducting layer arranged on the watch-glass and earth constituted by the case. This capacity is connected in parallel to the capacitive sensor. The potential $U_{out}$ detected by the comparator may thus be expressed by the relationship:

$$U_{out} = U_{in}\,(C_{ref})/(C_p + C_d + C_{ref})$$

where $U_{in}$ is the voltage applied to the capacitive divider by the generator, $C_p$ is the parasitic capacity, $C_d$ is the capacity of the capacitive sensor and $C_{ref}$ is the capacity of the independent capacitor.

Such devices have the disadvantage that, in order to provide them with an acceptable resolution, capacities $C_d$ and $D_{ref}$ must be substantially greater than that of the parasitic capacity, leading to a high consumption of current which notably reduces the life span of the watch battery. Further, the comparator which compares the voltage detected by the capacitive divider to a reference voltage is an analog component which, in order to have the requisite accuracy, must comprise a complex arrangement of transistors.

These disadvantages are particularly felt in the case of a watch including a large number of manual control devices. This is the case, for example, of so called "handwriting recognizing" watches which can receive commands when the user's finger "writes" a sign, for example an alphanumerical sign, such as a figure on the watch-glass. The watch must in such case be equipped with several tens of control devices each having a capacitive sensor arranged on the surface of the glass to enable the position of the finger on the external face of the glass to be recognised instantaneously. The consumption of each control device in such case constitutes a significant factor in determining the life span of the watch battery.

SUMMARY OF THE INVENTION

An aim of the present invention is to provide a watch equipped with a manual control device which overcomes, at least in part, such disadvantages.

The present invention thus concerns a watch comprising a case which constitutes earth, a glass and at least one manual control device which is connected to a processing circuit intended to execute a predetermined function of the watch by the action of said manual control device, the latter comprising:

a capacitive sensor comprising a first armature arranged on the internal face of the glass, and whose other armature is selectively formed by the positioning of a finger of a user of said watch on the external face of the glass, this capacitive sensor being thus intended to form a first capacity, said watch also having a second parasitic capacity between said first armature and the case, characterised in that said manual control device also comprises a voltage-frequency converter whose input is connected to the common junction between said first armature and said second capacity, a frequency detector connected between said converter and said processing circuit, so that the oscillation frequency of said converter varies as a function of the presence or absence of the user's finger on said external face of the glass.

Thus, in order to obtain a resolution of the manual control device comparable to that of the device of the Swiss patent cited above, the capacity of the capacitive sensor can be reduced in comparison to that of the sensor used in the prior art. The consequence of this is that the charge required to be placed on the capacitive sensor may be markedly weaker, resulting in a lower energy consumption, each time that the user wishes to execute a command. The life span of the watch battery can therefore be prolonged.

Further, by using the capacitive sensor and the parasitic capacity of the watch as elements determining the frequency of the voltage-frequency converter, the present invention enables a control signal to be created whose detection of logical states can be achieved by numerical means, which are simpler to achieve than those of an analogue circuit used in the prior art.

BRIEF DESCRIPTION OF THE DRAWINGS

Other characteristics and advantages of the invention will appear during the following description, which is given purely by way of example and made with reference to the attached drawings in which.

DETAILED DESCRIPTION OF THE DRAWINGS

Figure 1:
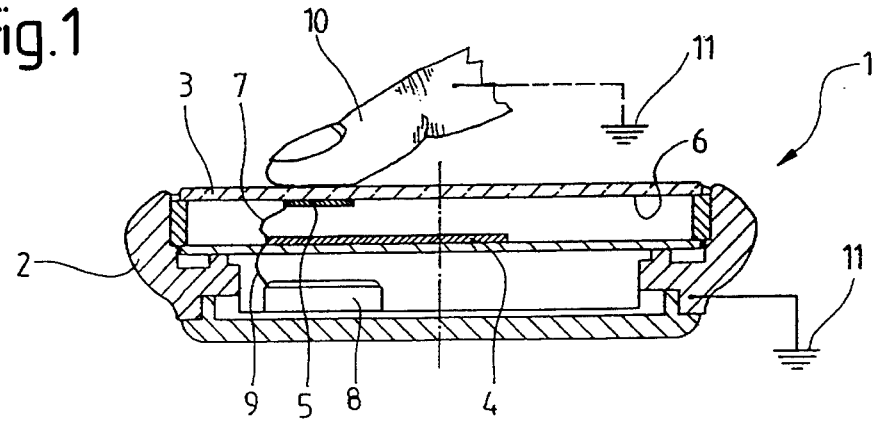
FIG. 1 shows a schematical cross-sectional view of the arrangement of a capacitive sensor according to the present invention.

FIG. 1 shows a cross-sectional view of a watch 1 comprising a case 2 and a glass 3. An electronic circuit 4 is arranged in case 2. A conducting electrode 5, preferably transparent, is arranged on the internal face 6 of the glass of watch 1. Electrode 5 is connected to electronic circuit 4 by a conductor 7. A battery or other source of electric energy 8 is also placed in case 2 and is connected to the positive pole of electronic circuit 4 by a conductor 9.

Electrode 5 forms one of the armatures of a capacitive sensor 20, the other armature 21 of capacitive sensor 20 being formed by the finger 10 of the wearer of watch 1 when, in order to carry out a predetermined watch command, he touches the external face of glass 3 at the location of electrode 5. The wearer's finger 10 is connected to earth ground 11 of the electronic circuit, as is the rest of the wearer's body, via case 2 which is in contact with the latter's wrist and which is connected to the negative poles of electronic circuit 4 and battery 8.

Figure 2:
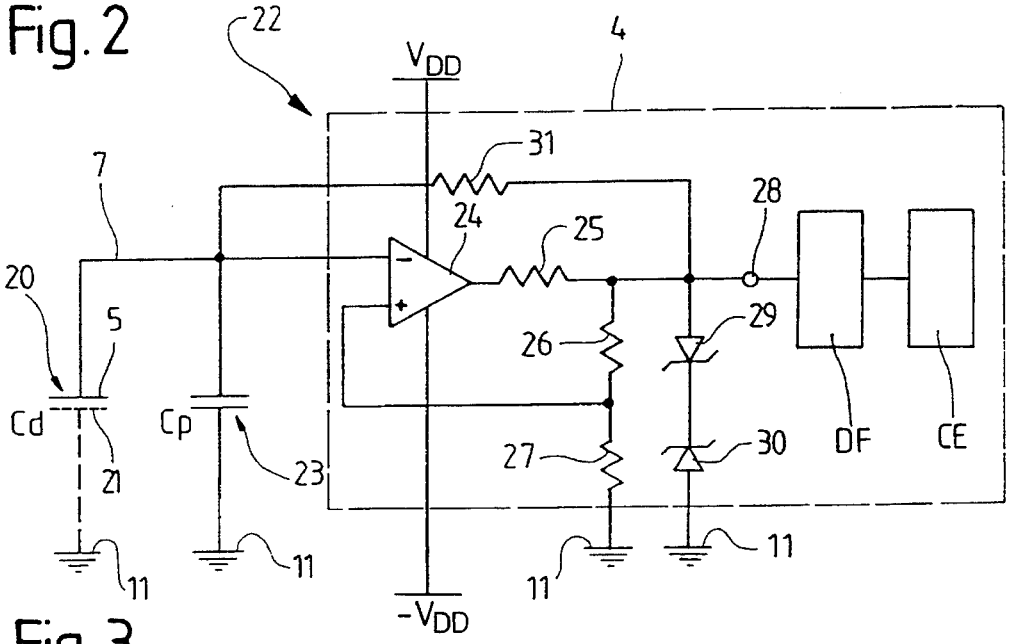
FIG. 2 shows a block diagram of a preferred embodiment of a manual control device intended to be used with a watch according to the present invention.

FIG. 2 shows a block diagram of a manual control device 22 used in watch 1 of FIG. 1 which enables a control signal to be generated in response to the activation of capacitive sensor 20. This device 22 is connected to a frequency detector DF and connected in turn to a processing circuit CE which enables the watch function which the user wishes to execute to be carried out, in a well known manner.

Control device 22 includes a capacitive sensor 20 while a parasitic capacity $C_p$ is, as a result of the construction, present inbetween electrode 5 and case 2 of watch 1. This parasitic capacity is represented in FIG. 2 by a capacitor 23. Capacitive sensor 20 and capacitor 23 are connected in parallel between earth 11 and the inverting input of an operational amplifier 24.

Manual control device 22 also comprises resistors 25, 26 and 27 all connected in series between the output of amplifier 24 and earth 11. The non-inverting input of amplifier 24 is connected to a junction between resistors 26 and 27. In this configuration, amplifier 24 and resistors 25, 26 and 27 form a Schmitt trigger which provides at its output 28, that is to say at the junction between resistors 25 and 26, a signal with either a high logical level or a low logical level, as a function of the relative voltage values present at the inverting and non-inverting inputs of amplifier 24. Two Zener diodes 29 and 30 arranged head to tail are connected between output 28 and earth 11, so as to stabilise the voltages respectively defining these logical levels.

Manual control device 22 also includes a resistor 31 connected between output 28 and the inverting input of amplifier 24. This resistor 31, together with capacitive sensor 20 and capacitor 23, forms part of a low-pass filter which integrates the voltage at the output of the Schmitt trigger. The potential of the armatures of capacitors 20 and 23 is applied at the inverting input of amplifier 24. As a result manual control device 22 functions as a voltage-frequency converter, in other words, a voltage controlled oscillator.

In the embodiment illustrated in FIG. 2, the voltage-frequency converter has been designed in the form of an astable multivibrator, for it creates a periodic signal with two quasi-stable states while oscillating freely. However, it may also be designed in the form of any type of periodic signal generator or in another form of voltage controlled oscillator. The arrangement illustrated in FIG. 2 is particularly advantageous because of its simplicity of construction and the fact that no high precision electronic components are required.

The oscillation period T of control device 22 is given by the relationship:

$$T=2R_{31}C_{tot}\ln(1+(2R_{26})/R_{27})$$

where $R_{31}$, $R_{26}$ and $R_{27}$ are respectively the values of resistors 31, 26 and 27 and $C_{tot}$ is the total capacity between the inverted input of amplifier 24 and earth 11. One can thus see that the oscillation frequency of the output signal of manual control device 22 is inversely proportional to total capacity $C_{tot}$ and the capacity of the capacitive sensor in combination with the parasitic capacity therefore determines the oscillation frequency value of manual control device 22.

The oscillation frequency of the voltage-frequency converter thus varies as a function of the presence or absence of the user's finger on the external face of the glass. If finger 10 of the wearer of watch 1 is not placed on glass 3, armature 21 of capacitive sensor 20 is consequently absent from the circuit shown in FIG. 2. Total capacity $C_{tot}$ is in this case equivalent to parasitic capacity $C_p$ between electrode 5 and earth 11. The oscillation frequency of the output signal of control device 22 is then inversely proportional to parasitic capacity $C_p$.

On the other hand, when finger 10 is placed on glass 3, armature 21 is formed and capacitive sensor 21 consequently effectively acts upon control device 22. In these conditions, total capacity $C_{tot}$ is equivalent to the inverse of the sum of capacities. $C_d$ and $C_p$. Thus the oscillation frequency of the output signal of control device 22 is inversely proportional to the sum of capacities $C_d$ and $C_p$.

As the desired information in the output signal is contained in its frequency, rather than being in the absolute value of its amplitude, it is sufficient to use simply designed numerical means in order to extract it. These means may be achieved, for example, by a pulse counter which is operated during a fixed operating period. The frequency and thus the presence or absence of the finger on the external face of the watch-glass, is directly represented by the number of pulses received during this fixed period. These means are not described in any more detail here as they are well known to a man skilled in the art.

Figure 3:
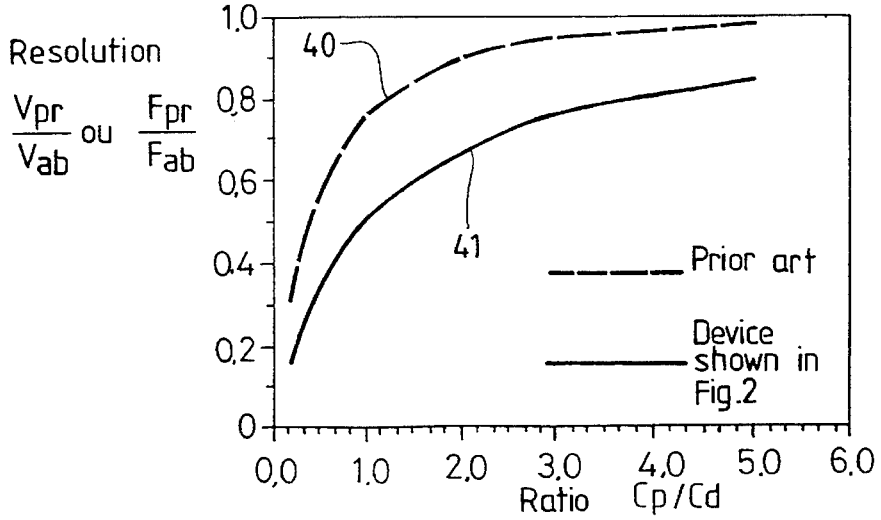
FIG. 3 is a graph showing the resolution attained by a watch according to the present invention and by a watch of the prior art as a function of the capacity of their capacitive sensors.

FIG. 3 is a graph showing that the resolution and the energy consumption of the present invention are better in comparison to those obtained in the prior art. On the horizontal axis of this graph the relationship $C_p/C_d$ is marked, that is to say, the relationship between the parasitic capacity established between fixed electrode 5 of the capacitive sensor and case 2 and capacity $C_d$ of capacitive sensor 20. On the vertical axis the relative resolution of the manual control device is marked, in other words the relationship between the low logical state and the high logical state of its output signal.

Curve 40 represents, in the case disclosed in the above cited patent CH 607 872, the relative deviation $V_{p}/V_{ab}$ between the two voltage values detected by the comparator, respectively in the presence and absence of the user's finger. The value of capacity $C_{ref}$ has been taken as being equivalent to the value of capacity $C_d$.

Curve 40 shows that there is a large deviation between the analogue voltage levels of the prior device, and that a high resolution is thus attained, if the ratio $C_p/C_d$ is relatively small. But in these conditions, capacity $C_d$ of the capacitive sensor must be markedly greater than parasitic capacity $C_p$, which will increase the consumption of the manual control device. Conversely, a comparatively low $C_p/C_d$ ratio reduces the manual control device resolution, but a lower energy consumption is obtained, as capacity $C_d$ is then smaller.

Curve 41 of FIG. 3 represents, in the case of the invention, the deviation between the two frequency values $F_{pr}$ and $F_{ab}$ generated at the output 28 of control device 22, respectively when the finger of a wearer of watch 1 is placed on glass 3 and when it is absent from said glass, again as a function of the ratio $C_p/C_d$.

It is to be noted that, in order to establish a valid comparison between curves 40 and 41, they have been plotted by placing the smallest voltage frequency ratio at the numerator. It happens that the greatest voltage value (to the extent that the case of the Swiss patent cited above is considered) is generated in the absence of the finger, as in the case of the invention.

By drawing a comparison between curves 40 and 41, it can be seen that a marked improvement in resolution is obtained in the embodiment of the present invention shown in FIG. 2 compared to the case of the prior art. For example, in the case where capacity $C_d$ is equal in value to capacity $C_p$, the resolution is 25% greater than that of the prior art.

Further, in order to obtain a resolution of for example 0.5%, in the case of the prior art capacity $C_d$ must be at least two times greater than parasitic capacity $C_p$, which represents a considerable increase in the energy consumption of the watch battery, compared to that which is obtained for a same resolution in the case of the invention.

It is to be noted that several modifications and/or improvements may be made to the watch according to the invention without departing from the framework of the latter. In particular, the invention also concerns watches which recognise handwriting comprising a plurality of manual control devices of the type in FIG. 2, so as to follow the position of a watch wearer's finger on the glass and, consequently, to enable a figure or a letter written by the wearer on the glass to be recognised. In this case, frequency detectors DF of all the manual control devices can be connected to processing circuit CE of the watch, while electrodes 5 of their capacitive sensors form an appropriate motif on watch-glass 3.

In another embodiment, the manual control device may comprise several capacitive sensors of the type defined above, the common junctions between the first armature and the second capacity of each of these capacitive sensors all being connected to the input of a multiplexor. In such case, the output of the multiplexor is connected to the input of the control device frequency detector.

In this manner, only a single voltage-frequency converter is required which gauges each capacitive sensor at a frequency determined by the operation of the multiplexor. A man skilled in the art will understand that capacity $C_d$ of the capacitive sensor shown in FIG. 2 may vary according to the exact position of the user's finger on the watch-glass. Thus the voltage-frequency converter oscillator frequency can gradually change when a finger placed on the glass moves closer to or further away from the first armature of the capacitive sensor. In order to enable the presence or absence of the finger facing the capacitive sensor to be detected, a sensitivity threshold can be defined corresponding to a given change in frequency. When the change in the voltage-frequency converter frequency is greater than the sensitivity threshold, this change is detected by the processing circuit. This sensitivity threshold may be different for each capacitive sensor forming the manual control device, and the values of all these thresholds can be stored in a memory in the processing circuit.

In the case of a manual control device comprising several capacitive sensors, the position of a user's finger may be detected by analysing the change in frequency caused by each capacitive sensor. Thus, the change in frequency caused by the position of the finger on the watch-glass will be more pronounced for the capacitive sensors furthest from the finger. By analysing the frequency changes of the capacitive sensors as a whole, the position of the finger can be determined.

We claim:

1. A watch comprising a case constituting ground, a glass and at least one manual control device, which is connected to a processing circuit for executing a predetermined watch function by the action of said manual control device, said manual control device comprising:

a capacitive sensor comprising a first armature placed on an internal face of the glass such that another armature is selectively formed by the positioning of a finger of a user of said watch on the external face of the glass, said capacitive sensor thereby forming a first capacity, and said watch also having a parasitic second capacity between said first armature and the case, a voltage-frequency converter whose input is connected to a common junction between said first armature and said second capacity, and a frequency detector connected between said converter and said processing circuit, so that the oscillation frequency of said converter varies as a function of the presence or absence of the user's finger on said external face of the glass.

2. A watch according to claim 1, wherein said voltage-frequency converter is in the form of an astable multivibrator.

3. A watch according to claim 2, wherein said common junction is connected to the input of an amplifier forming part of said astable multivibrator.

4. A watch according to claim 1 further comprising a plurality of said manual control devices whose capacitive sensors together form a motif on the glass to enable handwriting on the external face of said glass to be recognized, the frequency detectors of all the control devices being connected to said processing circuit.

5. A watch according to claim 1 further comprising a plurality of said capacitive sensors, which together form a motif on the glass to enable handwriting on the external face of said glass to be recognized, and a multiplexor whose output is connected to the input of said voltage-frequency converter, the common junctions between said first armature and said second capacity of said capacitive sensors all being connected to the input of said multiplexor.

6. A watch according to claim 2 further comprising a plurality of said manual control devices whose capacitive sensors together form a motif on the glass to enable handwriting on the external face of said glass to be recognized, the frequency detectors of all the control devices being connected to said processing circuit.

7. A watch according to claim 3 further comprising a plurality of said manual control devices whose capacitive sensors together form a motif on the glass to enable handwriting on the external face of said glass to be recognized, the frequency detectors of all the control devices being connected to said processing circuit.

8. A watch according to claim 2 further comprising a plurality of said capacitive sensors, which together form a motif on the glass to enable handwriting on the external face of said glass to be recognized, and a multiplexor whose output is connected to the input of said voltage-frequency converter, the common junctions between said first armature and said second capacity of said capacitive sensors all being connected to the input of said multiplexor.

9. A watch according to claim 3 further comprising a plurality of said capacitive sensors, which together form a motif on the glass to enable handwriting on the external face of said glass to be recognized, and a multiplexor whose output is connected to the input of said voltage-frequency converter, the common junctions between said first armature and said second capacity of said capacitive sensors all being connected to the input of said multiplexor.

* * * * *